US006581306B1

(12) United States Patent
DiClementi et al.

(10) Patent No.: US 6,581,306 B1
(45) Date of Patent: Jun. 24, 2003

(54) VEHICLE PLOW LIFT DEVICE

(76) Inventors: James Anthony DiClementi, 1909 E. Euclid Ave., Mount Prospect, IL (US) 60056; Robert Daniel DiClementi, 2110 Illinois Rd., Northbrook, IL (US) 60062; Linda Rose DiClementi, 911 N. Kennicott, Arlington Heights, IL (US) 60004

( * ) Notice: Subject to any disclaimer, the term of this patent is extended or adjusted under 35 U.S.C. 154(b) by 0 days.

(21) Appl. No.: 10/058,918

(22) Filed: Jan. 28, 2002

(51) Int. Cl.[7] ..... E01H 5/04; F16M 13/00

(52) U.S. Cl. ..... 37/231; 37/232; 37/236; 248/565; 248/610

(58) Field of Search ..... 37/231, 232, 235, 37/236; 248/565, 560, 610, 611, 613

(56) References Cited

U.S. PATENT DOCUMENTS 4,947,563 A 8/1990 Pfister, Jr. ..... 37/231

6,088,937 A 7/2000 DiClementi et al. ..... 37/232

*Primary Examiner*—Christopher J. Novosad
(74) *Attorney, Agent, or Firm*—Piper Rudnick

(57) ABSTRACT

A lift device mounted on a vehicle is provided for lifting a vertically movable assembly mounted to the vehicle. It has a primary lift arm in pivotal relation to the vehicle with a near end and a distal end disposed generally above the assembly. A secondary lift arm is pivotally mounted on the primary lift arm and has a free end. A hanging mechanism secures the assembly to the free end to suspend the assembly from the free end. A positioning mechanism raises and lowers the distal end of the primary lift arm to raise and lower the assembly and to hold the assembly off of the ground on which the vehicle travels. An elastic member attenuates resultant forces originating at the assembly and transmitted from the secondary lift arm to the primary lift. The forces are therefore absorbed preventing transmission of the forces to the vehicle.

27 Claims, 3 Drawing Sheets

VEHICLE PLOW LIFT DEVICE

FIELD OF THE INVENTION

This invention relates to vehicle mounted plows. More specifically, the invention relates to an improved plow lift device for attenuating shocks normally imparted to a vehicle as the vehicle moves over and across uneven terrain.

BACKGROUND OF THE INVENTION

Known vehicles have snow plow blades affixed to a front end of the vehicle. These plow blades have a substantial mass and are very heavy. Moreover, the plow blades are releasably mounted to the frame of the vehicle and permit movement between a lowered working or operational position and a raised storage or suspended position.

A mounting structure or frame is attached to the forward end of the vehicle to hold the plow blade. Usually, the plow blade is hung or suspended forwardly of the mounting structure in a manner permitting vertical movement. A lift assembly operably positions the plow blade between its suspended transport or raised position and its operating or lowered position. Such lift assembly usually includes a lift arm adapted for movement about a pivotal axis. A driver controls movement of the lift arm and thereby the plow blade. A chain or cable system typically connects the plow blade to the lift arm.

As the vehicle is driven across uneven terrain or surfaces, i.e. railroad crossings, ruts, potholes and the like, the elevated plow blade can present significant problems and major difficulties. More specifically, when the plow blade is not in its lowered or work engaging position, forces are magnified by a moment arm around which the plow acts due to the mass of the plow blade being positioned on the far end of the plow frame away from the vehicle. The momentum imparted to the plow blade as the vehicle is driven over uneven terrain causes the suspended plow blade to bounce. That is, the uneven surface terrain causes initial upward movement of the plow blade toward the lift arm and subsequent forceful movement downwardly until the chains or cable limit its travel. Without any plow suspension system, when the plow blade reaches the travel limit of the associated chain or cable, such chain or cable will jerk the plow blade to a sudden stop, transmitting a sudden and sharp jolt of force back to the vehicle through the mounting structure. As will be appreciated, such bouncing of the plow blade happens repeatedly as the vehicle is driven or transported between locations.

The effect of the significant mass/weight of the plow blade on the vehicle suspension system is significantly magnified when considering the repetitive bouncing movement of the plow blade as the vehicle is driven from location to location. This repeated bouncing of the plow blade can adversely impact the vehicle's suspension system by causing significant and rapid wear and tear thereof. Moreover, repeated bouncing of the plow blade can result in damage to a vehicle frame and/or the plow blade mounting structure. Furthermore, repeated bouncing of the plow blade causes extreme tensile stress loading of the chains or cables holding the plow blade in a suspended position. Of course, if such chains or cables should snap or break, the plow blade will crash thus enhancing the potential for accidents not only with the vehicle having the plow blade mounted thereon, but with other vehicles in the vicinity. Also, the potential bouncing of the plow blade can interfere with the steerability of the vehicle.

Furthermore, similar problems and difficulties may be encountered when the plow blade is lowered to its operating position. In this position, the plow blade is in contact with the road or off-road surface the vehicle is traveling on. To ensure proper contact between the plow and the surface to be plowed, the lift assembly is positioned such that the chains or cables do not support the full weight of the plow. The surfaces to be plowed, however, are commonly marred with uneven portions such as the joints associated with misaligned road surface segments, speed bumps, ruts, potholes and the like. When the plow blade contacts such imperfections in the road surface, the plow blade may be forced initially upward and then subsequently downward back to the road. Without any plow suspension system, the plow blade will freely plummet back to the ground or, if the surface imperfection is large enough, will snap to a sudden stop as the chains or cables are drawn taut. The resulting forces can be quite severe, and these forces are transmitted back to the vehicle through the mounting structure. As will be appreciated, such displacement of the plow blade may happen repeatedly as the vehicle operates to plow road and similar surfaces.

Thus, there is a need and a desire for a plow capable of attenuating shocks normally imparted to a vehicle by a plow blade as the vehicle moves over and across uneven terrain.

U.S. Pat. No. 4,947,563, issued to Paul T. Pfister, Jr., discloses a vehicle plow-suspension shock-absorber. Pfister involves a compression spring situated in line with the chain or cable that interconnects the plow blade to the lift arm. By adding such a compression spring, downward forces on the plow blade relative to the vehicle are dampened when the plow blade is in the raised storage or suspension position. Pfister, however, does not dampen the impact or shock to the vehicle caused by jerking motion of a lift arm initiated by instant release of weight from the upward movement of the plow blade, and has little if any effect when the plow blade is in the lowered working or operational position when the cable is slack.

In one alternative solution, U.S. Pat. No. 6,088,937 by the current inventors, discloses an improved plow with a suspension system attached to the chain or line that holds the plow blade. A two-way shock absorber is used and has a compression spring wrapped around a piston.

The present lift device offers another alternative solution addressing the problems recited above. Thus, it is a main object of the present invention to provide an improved plow lift device that provides a smooth ride in the plow vehicle despite vertical movement of the plow blade.

More specifically, it is an object of the present invention to provide an improved plow lift device that absorbs substantially all forces formed by the vertical movement of a plow blade, and prevents those forces from impacting the vehicle or suspension system of the vehicle holding the plow blade.

SUMMARY OF THE INVENTION

The invention may be broadly defined as a device for attenuating shock to a motor vehicle when a large load or object such as a plow blade is mounted thereon. The vehicle plow lift device attenuates the relative movement between the plow blade and vehicle, the resulting forces, and the transmission of such forces from the plow blade to the vehicle so that the forces are negligible or eliminated entirely when finally transmitted to the vehicle. Both upward and downward relative movement are dampened, and the invention operates both when the plow blade is in its raised storage or suspended position and when the plow blade is in its lowered working or operational position.

In one aspect of the invention, the lift device is.mounted on a vehicle and lowers, raises or carries a vertically movable assembly mounted to the vehicle. It has a primary lift arm in pivotal relation to the vehicle and a distal end disposed generally above the assembly. A secondary lift arm is pivotally mounted on the primary lift arm and has a free end. A hanging mechanism secures and suspends the assembly from the free end. A positioning mechanism raises and lowers one of the lift arms which ultimately raises and lowers the assembly or holds the assembly off of the ground on which the vehicle travels. An elastic member attenuates resultant forces originating at the assembly and transmitted from the secondary lift arm to the primary lift arm which prevents transmission of the forces to the vehicle.

Another aspect of the invention is that it comprises a compression spring that acts in unison with a dampener, such as a two-way shock absorber. In more detail, as the vehicle is driven between locations, the positioning means is normally conditioned to elevate the plow blade to a raised storage or suspended position. In such position, in accordance with the present invention, the compression spring and dampener of the lift device, through the secondary lift arm, resiliently suspends the plow blade in a raised position. When unstable road conditions are encountered, such as road divots, potholes, unstable railroad crossings, medians, and the like, the lift device controls movement of the raised plow blade to decrease or eliminate shock to the vehicle. When the plow blade moves upwardly in response to the vehicle moving over rough or bumpy terrain, the sudden release of weight initially causes the compression spring to expand and lift the secondary lift arm upward. However, the continued expansion of the spring and the compression of the piston of the two-way shock absorber eventually combine to slow or stop the upward movement of the secondary lift arm and absorb the upward forces.

When the plow blade falls back downward pulling the secondary lift arm downward as well, the two-way shock absorber receives a tensile force and is lengthened while the compression spring is compressed. Again, the combination of spring and dampener slows and controls the downward movement of the plow blade thus attenuating the shock imparted to the vehicle effectively creating a free "floating" weight. By floating the weight of the plow blade, the present invention significantly attenuates the shock imparted to the vehicle as compared to the dead weight of a plow blade merely suspended directly from a single lift arm secured to the vehicle. While either the compression spring or dampener could be used alone, the combination of the two creates a truer "floating" configuration where the plow blade bounces up and down without transmitting those forces to the vehicle.

When the plow blade is in the lowered working or operational position, as is customary, the weight of the plow blade is substantially supported by the surface to be plowed. This arrangement ensures that the plow blade will make adequate contact with the plowing surface such that snow and similar objects on the surface may be removed by the plow blade. Thus, the secondary lift arm supports little to none of the weight of the plow blade. However, as is common in the field, due to the unevenness or other imperfections in the plowing surface, forces may be imparted to the plow blade which cause relative motion between the plow blade and the vehicle, and resultant forces transmitted to the vehicle. The lift device of the present invention allows this necessary movement but, under appropriate circumstances, can temporarily "float" weight of the plow and thus reduce the impact or shock which result when the plow blade impacts the plowing surface.

BRIEF DESCRIPTION OF THE DRAWINGS

The above mentioned and other features of the present invention and the manner of obtaining them will be apparent, and the invention itself will be best understood by reference to the following description of the preferred embodiment of the invention in conjunction with the drawings, in which.

DETAILED DESCRIPTION

Figure 1:
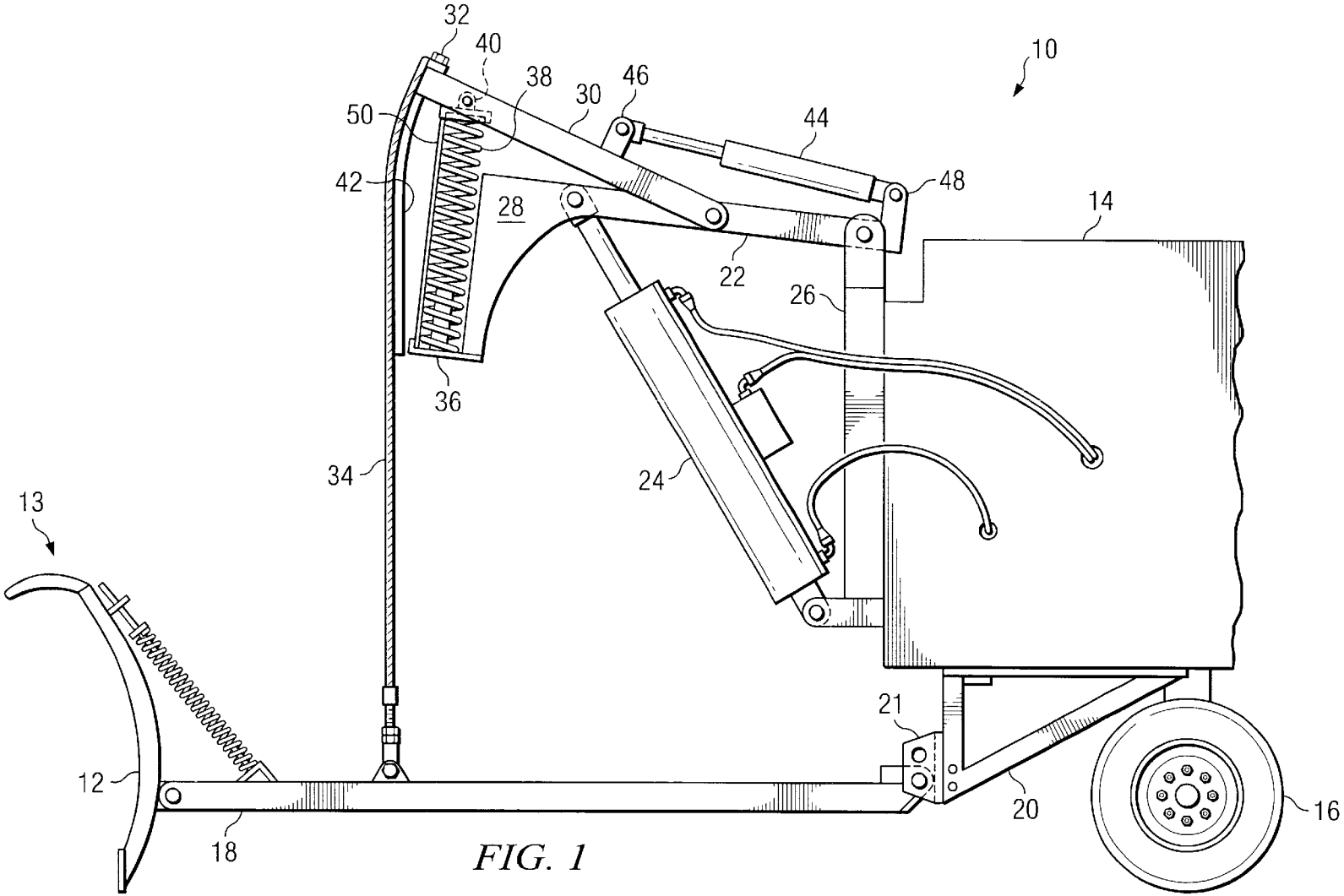
FIG. 1 is a simplified side view of the plow lift device with a plow blade in accordance with the present invention.

Referring to FIG. 1, a plow lift device indicated generally at 10 suspends a plow blade assembly 13 including a plow blade 12 and a vehicular mount 18 attached to the front of a vehicle represented by body 14 and tire 16. The vehicular mount 18 horizontally braces the plow blade 12 relative the vehicle, and may be configured in an A-frame or similar horizontally stabilizing structure. The vehicular mount 18 is attached to a submount assembly 20 by vertically pivotal hinge 21 as known in the art. The sub-mount assembly 20 attaches the vehicular mount 18 to the underside of a frame (not shown) of the vehicle as known in the art.

The plow lift device 10 includes a horizontally extending, generally L-shaped primary lift arm 22 pivotally mounted to a top of a vertical brace 26 attached to the front of the vehicle. A hydraulically operated lift pump or cylinder 24 has one end pivotally mounted to a bottom of the vertical brace 26 and another end pivotally mounted near a distal end 28 of the primary lift arm 22. With this configuration, the distal end 28 of the primary lift 22 is raised and lowered by operation of the cylinder 24. It will be appreciated that the present invention is designed to operate with any positioning device that can raise and lower the plow blade 12 or other weight.

The plow lift device 10 also has a secondary lift arm 30 actually made of two parallel bars 31*a*, 31*b* (best seen in FIG. 2) that are pivotally mounted to the primary lift arm 22 and extend above and past the distal end 28 of the primary lift arm. A hook 32 or other fastener for hanging a line, cable or chain 34 is disposed at the free end of the secondary lift arm 30. The bottom end of the cable or chain 34 is attached to the vehicle mount 18.

The L-shaped primary lift arm 28 is disposed so that the short leg of the "L" is at the distal end 28, extends generally vertically and points downward. A bottom, cup-shaped retainer 36 is attached to the bottom of the primary lift arm 28, by welding or fasteners for example, and holds the bottom of a resilient or elastic member 38 that can support the weight of the plow blade assembly 13, such as a helical compression spring or other resilient mechanism such as a rubber block. The short leg of the primary lift arm 22 is used to stabilize, and provide lateral support for, the spring 38. The top of the compression spring 38 is connected to the secondary lift arm 30 by an inverted cup-shaped top retainer 40.

Figure 2:
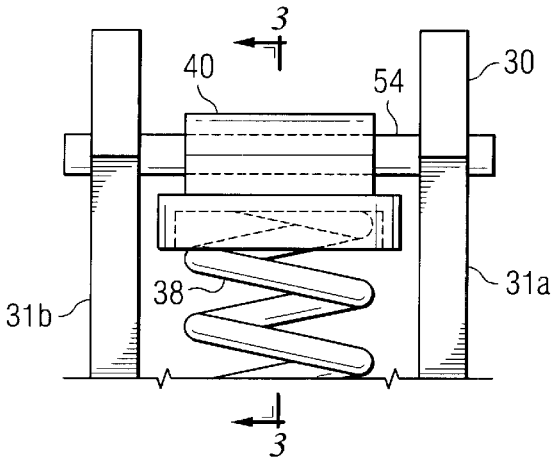
FIG. 2 is a forward end view of a portion of the plow lift device in accordance with the present invention.
Figure 3:
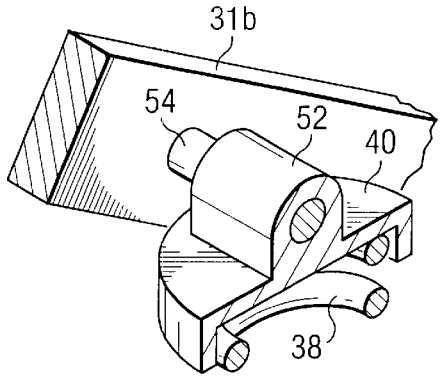
FIG. 3 is a cross-sectional perspective view of a portion of the plow lift device taken substantially along lines 3—3 on FIG. 2.

Referring to FIGS. 2–3, the top retainer 40 has a fastened, welded or integrally formed tubular portion 52 that is pivotally mounted on a bolt or pin 54 received by the tubular portion. The bolt 54 is preferably secured to both of the secondary lift arm bars 31*a*, 31*b*. With this configuration the top retainer 40 is free to pivot between and parallel to the bars 31*a*, 31*b* regardless of the angle of the lift arm 30 in order to maintain the generally upright or vertically extending position of the compression spring 38 and to prevent bending of the spring 38.

Referring back to FIG. 1, a chain guide 42 hangs from the secondary lift arm to prevent the chain from interfering with the spring 38, and the spring 38 may be covered by a protective sleeve 50, made of folding plastic or telescoping metal cylinders for example (not shown), to protect the spring from debris or even to further maintain the compression spring in its vertical orientation.

A dampening device 44, such as a two-way shock absorber or tension bar, disposed above the lift arms 22, 30 has one end rotatably mounted to the secondary lift arm 30 via bracket 46 at a central location on the secondary lift arm, and another end rotatably mounted to the primary lift arm 22 via a bracket 48 integrally formed with, or welded to, the near end of the primary lift arm by its point of pivotal attachment to the vertical brace 26. The damper 44 may be the present inventor's shock absorber disclosed in U.S. Pat. No. 6,088,937 that includes its own expansion spring coiled around a piston to absorb both compression and tension forces.

In operation, the vehicle plow lift device 10 of the present invention serves to attenuate shocks normally imparted to the vehicle 14 from the mounted plow blade 12 as the vehicle and mounted plow blade move over and across uneven terrain, both when the plow blade is in the raised storage or suspended position and when the plow blade is in the lowered working or operational position.

When the primary lift arm 22 and associated hydraulically operated lift cylinder 24 elevates the plow blade 12 to a raised storage or suspended position, the compression spring 38 reaches a maximum or balanced compression point where it cannot or will not contract further and where the secondary lift arm 30 is essentially balanced on the spring 38 toward the free end. At that point, the upward movement of the primary lift arm 22 applies an upward force to the free end of the secondary lift arm 30. This action pulls the chain 34 upward lifting the plow blade 12 upward to resiliently suspend the plow blade in the raised position. When a shock to the plow blade 12 is received, such as due to unstable road conditions, that moves the plow blade 12 violently and quickly upward causing slack in the chain 34, the compression spring 38 will expand snapping the secondary lift arm 30 upward. However, this shock is then absorbed by the compression of dampener 44 and slowed by the tension at the spring 38 preventing the shock from reaching the vehicle 14. If the plow blade then falls downward pulling the chain 34 taut, which causes a violent downward force or shock on the free end of the secondary lift arm 30, the downward shock is absorbed by compression of the spring 38 and slowed by tension at the dampener 44.

In either case (downward or upward shock), the combined reciprocal action of spring 38 and dampener 44 substantially entirely absorbs the shock before it is transmitted to primary lift arm 28 or vertical brace 26. Thus, a true floating of the weight of the plow blade 12 occurs.

When the plow blade 20 is in the lowered working or operational position, the weight of the plow blade is substantially supported by the surface to be plowed such that the plow blade 20 will make adequate contact with the plowing surface in order to remove snow and similar objects from the surface. Thus, the compression spring 38 supports little to none of the weight of the plow blade 12 in this position. However, due to unevenness or other imperfections in the plowing surface, relative movement between the plow blade 12 and vehicle 14 may occur. The lift device 10 allows this necessary movement, but acts to reduce the resultant forces and their transmission to the vehicle 14. Where the plow blade 12 is induced to greater downward positions relative to the vehicle 10, the compression spring 38 and dampener 44 act to temporarily float or suspend the plow blade 12. This action will limit the eventual re-impact between the plow blade 12 and the plowing surface, and any resulting forces transmitted to the vehicle 14 are likewise reduced or eliminated.

It will be appreciated that the resilient member 38 or dampener 44 could be used alone, however, the system works best with both shock absorbers.

Figure 4:
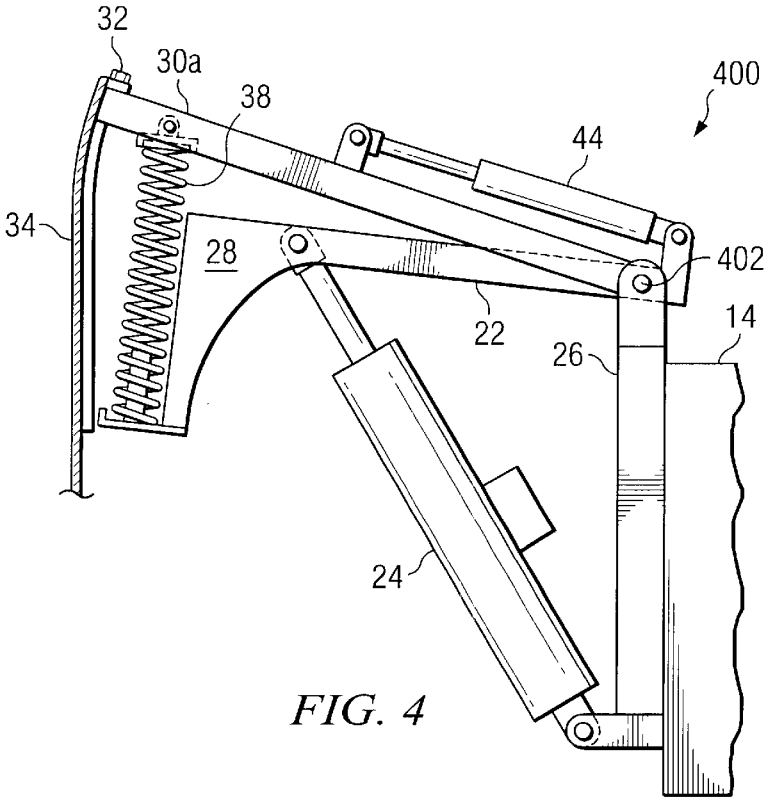
FIG. 4 is a simplified diagram showing one alternative plow lift device of the present invention.
Figure 5:
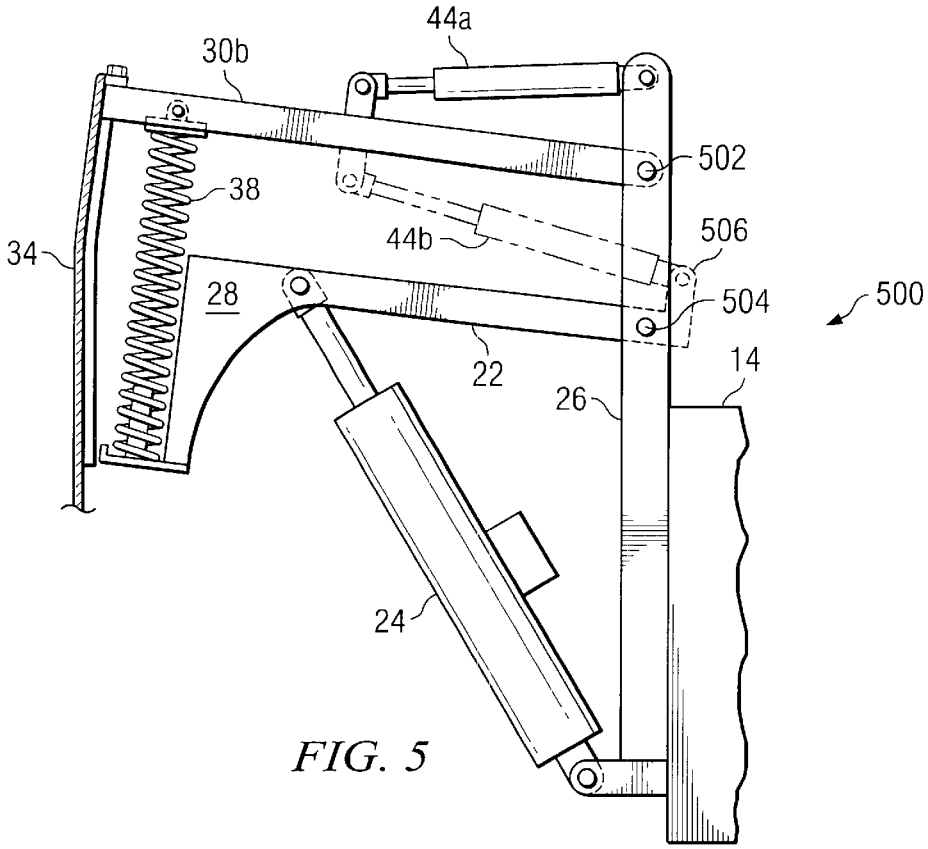
FIG. 5 is a simplified diagram showing one alternative plow lift device of the present invention.
Figure 6:
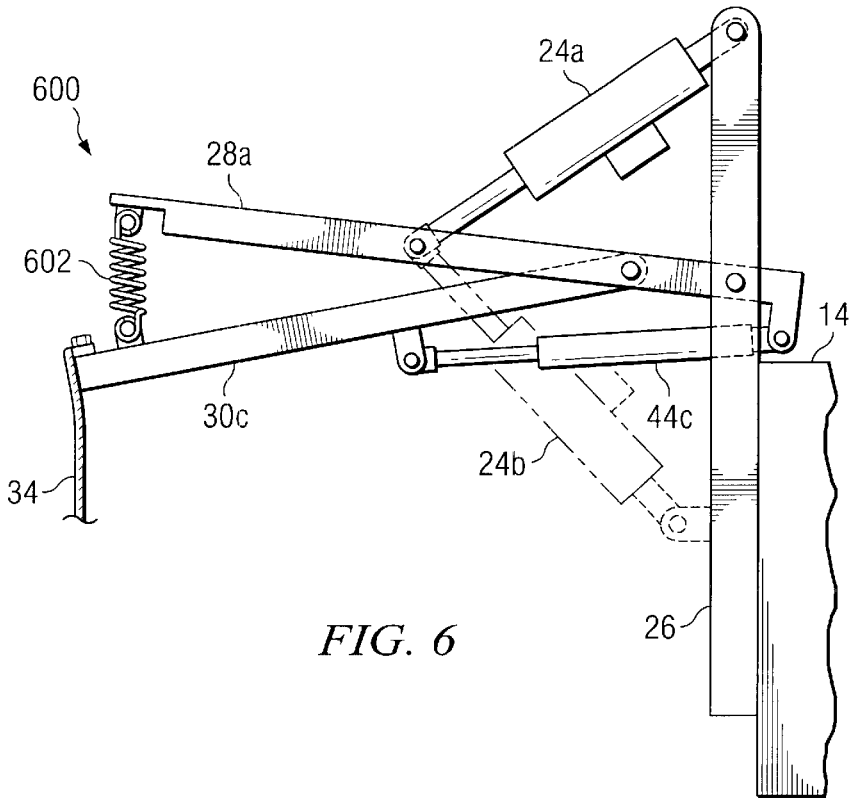
FIG. 6 is a simplified diagram showing one alternative plow lift device of the present invention.

Referring to FIGS. 4–6, alternative designs that use the same two-arm configuration can be implemented for the present invention even though not quite as economical as the design of FIG. 1. For reference, similar features as that of FIG. 1 are numbered similarly. FIG. 4 discloses a lift plow device 400 similar to that of plow lift device 10 of FIG. 1 except that a secondary lift arm 30*a* is directly mounted on the vertical brace 26 and pivots on the same pin 402 as primary lift arm 28 so the pivotal relation between the two pivot arms 28, 30*a* is maintained.

Referring to FIG. 5, in another aspect of the present invention, a plow lift device 500 has a secondary lift arm 30*b* that is pivotally mounted to the vertical brace 26, as with plow lift device 400, except that the secondary lift arm 30*b* has its own pivot location 502 separate from the connection and pivot point 504 of the primary lift arm 28. In this embodiment, a dampener 44*a* can be attached in the same upper location as with plow lift device 10 in FIG. 1 except that one end is pivotally attached to the vertical brace 26. In yet another alternative, a dampener 44*b* (shown in dash) can be placed below the secondary lift arm 30*b* to maintain the attachment to a bracket end 506 of the primary lift arm 28.

Referring to FIG. 6, in another aspect of the two-arm design, a plow lift device 600 uses an expansion spring or tension resilient member 602 instead of a compression member. In this configuration, a secondary lift arm 30*c* is disposed below a primary lift arm 28*a*. A dampener 44*c* is disposed below the lift arms 28*a*, 30*c* and has one end connected to each lift arm (except inverted relative to plow lift device 10). A hydraulic lift pump or cylinder 24*a* is attached to primary lift arm 28*a* and may be disposed above the lift arms as shown or in an alternative lower position 24*b* (as shown in dash). While this alternative does not provide the advantages of a compression spring, the two arm system still attenuates forces and reduces shock from movement of the plow blade.

It will be appreciated that other devices instead of plow blades could be used with this lift device such as rollers or any device that is dragged or pushed along the ground by a vehicle and/or has both a raised storage and a lowered operational position.

The advantages of the present plow lift device are now apparent. The lift device has an elastic member that attenuates resultant forces originating at the plow blade and transmitted from a secondary lift arm to a primary lift arm so that the forces are absorbed preventing transmission of the forces to the vehicle. A dampener is added to accomplish the same purpose but acts reciprocally and in unison with the elastic member. The elastic member is supported by an L-shaped primary lift arm.

While various embodiments of the present invention have been described, it should be understood that other modifications and alternatives can be made without departing from the spirit and scope of the invention, which should be determined from the appended claims.

What is claimed is:

1. A lift device mounted on a vehicle for raising, lowering and suspending a vertically movable assembly mounted on the vehicle, comprising:

a primary lift arm in pivotal relation to the vehicle and having a distal end disposed generally above the assembly;

a secondary lift arm is disposed on the lift device in pivotal relation to said primary lift arm and having a free end;

a hanging mechanism securing said assembly to said free end to suspend said assembly from said free end;

a positioning mechanism connected to the vehicle and for raising and lowering said primary lift arm to raise and lower the assembly and to suspend the assembly off of the ground on which the vehicle travels; and a resilient member attenuating resultant forces originating at said assembly and transmitted from said secondary lift arm to said primary lift arm, said resilient member being disposed at the location where said forces are transmitted from said secondary-lift arm to said primary lift arm, said resilient member absorbing said forces transmitted from said secondary lift arm and toward said primary lift arm preventing transmission of said forces to said vehicle.

2. The lift device of claim 1, wherein said secondary lift arm is pivotally mounted on said primary lift arm.

3. The lift device of claim 1, further comprising a frame disposed on the vehicle, both said primary and said secondary lift arms being pivotally mounted on said frame.

4. The lift device of claim 1, wherein said secondary lift arm is disposed above said primary lift arm so that downward movement of the assembly compresses said resilient member.

5. The lift device of claim 1, wherein a top of said resilient member is pivotally mounted to said secondary lift arm, said pivoting mount maintaining said resilient member in a generally vertically extending orientation.

6. The lift device of claim 1, further comprising a dampener pivotally connected to both said secondary lift arm and said primary lift arm for further attenuating said resultant forces transmitted from said secondary lift arm to said primary lift arm.

7. The lift device of claim 6, wherein said dampener is disposed so that said dampener receives tensile forces when said resilient member receives compressive forces, and said dampener receives compressive forces when said resilient member receives tensile forces.

8. The lift device of claim 6, wherein said dampener is disposed above said secondary and primary lift arms.

9. The lift device of claim 6, wherein said primary lift arm further comprises a near end opposing said distal end, and wherein one end of said dampener is secured to said secondary lift arm and another end of said damper is connected to said primary lift arm at said near end.

10. The lift device of claim 1, wherein said resilient member is a helical compression spring disposed for expansion and compression in a generally vertical direction.

11. The lift device of claim 1, wherein said primary lift arm is generally L-shaped with two legs.

12. The lift device of claim 11, wherein said primary lift arm is disposed generally horizontally so that one of said legs extends generally vertically for laterally supporting said resilient member.

13. The lift device of claim 1, wherein the assembly includes a plow blade and a sub-frame horizontally securing said plow blade to the vehicle.

14. The lift device of claim 1, wherein said hanging mechanism is a chain.

15. The lift device of claim 1, further comprising a shield disposed between said hanging mechanism and said resilient member to prevent said hanging mechanism interfering with operation of said resilient member.

16. A lift device mounted on a vehicle for raising, lowering and suspending a vertically movable assembly mounted on the vehicle, comprising:

a primary lift arm in pivotal relation to the vehicle and having a distal end disposed generally above the assembly;

a secondary lift arm in pivotal relation to said primary lift arm and having a free end;

a hanging mechanism securing said assembly to said free end to suspend said assembly from said free end;

a positioning mechanism for raising and lowering at least one of said lift arms to raise and lower the assembly and to hold the assembly off of the ground on which the vehicle travels; and a dampener pivotally connected to said secondary lift arm for attenuating resultant forces originating at said assembly and transmitted from said secondary lift arm, said dampener being disposed at the location where said forces already received by said secondary lift arm are transmitted from said secondary lift arm, whereby said forces transmitted from said secondary lift arm are absorbed preventing transmission of said forces to said vehicle.

17. The lift device of claim 16, further comprising a frame secured to the vehicle and wherein said dampener has one end connected to said secondary lift arm and an opposing end connected to said frame.

18. The lift device of claim 16, wherein one end of said dampener is secured to said secondary lift arm and an opposing end of said dampener is connected to said primary lift arm.

19. The lift device of claim 16, wherein said dampener is a two-way shock absorber.

20. The lift device of claim 16, further comprising a resilient member having one end connected to said distal end of said primary lift arm and another end connected to said secondary lift arm for further attenuating said resultant forces transmitted from said secondary lift arm to said primary lift arm.

21. The lift device of claim 20, wherein said dampener is disposed so that said dampener receives tensile forces when said resilient member receives compressive forces and said dampener receives compressive forces when said resilient member receives tensile forces.

22. The lift device of claim 20, wherein said secondary lift arm is disposed above said primary lift arm so that downward movement of the assembly compresses said resilient member.

23. The lift device of claim 20, wherein a top of said resilient member is pivotally mounted to said secondary lift arm for maintaining said spring in a generally vertically extending orientation.

24. The lift device of claim 20, wherein said primary lift arm is generally L-shaped with two legs.

25. The lift device of claim 24, wherein said primary lift arm is disposed horizontally so that one of said legs extends generally vertically for laterally supporting said resilient member.

26. A lift device mounted to a vehicle for raising a load to a transport position or lowered to an operating position, the lift device being disposed above and connected to said load, said lift device comprising:

a primary lift arm pivotally mounted on said vehicle and having a distal end;

a secondary lift arm mounted in pivotal relation to said primary lift arm, said secondary lift arm having a first end pivotally secured on the lift device and a second end secured to said load;

a positioning means connected to said primary lift arm for raising and lowering said assembly to said transport and operating positions;

a spring having one end secured to said distal end of said primary lift arm and a second end secured to said secondary lift arm, a dampener having one end pivotally mounted to said secondary lift arm and another end secured to said primary lift arm;

said dampener and said spring acting in unison to attenuate resultant forces originating at said assembly and transmitted from said secondary lift arm to said primary lift arm, whereby said forces are absorbed preventing transmission of said forces to said vehicle.

27. A lift device mounted to a vehicle for raising a load to a transport position or lowered to an operating position, the lift device being disposed above and connected to said load, said lift device comprising:

a generally L-shaped primary lift arm pivotally mounted on said vehicle and having a distal end;

a secondary lift arm disposed above said primary lift arm and having a first end pivotally mounted on said primary lift arm and a second end secured to said load;

a positioning means connected to one of said lift arms for raising and lowering said connected lift arm to said transport and operating positions;

a compression spring having a lower end secured to said distal end of said primary lift arm and an upper end secured to said secondary lift arm, said primary lift arm having a leg extending generally vertically for laterally supporting said compression spring, said compression spring attenuating resultant forces originating at said load and transmitted from said secondary lift arm to said primary lift arm, whereby said forces are absorbed preventing transmission of said forces to said vehicle.

* * * * *